US006525468B1

(12) United States Patent
Wada et al.

(10) Patent No.: US 6,525,468 B1
(45) Date of Patent: Feb. 25, 2003

(54) FLUORESCENT DISPLAY DEVICE WITH CONDUCTIVE LAYER COMPRISING ALUMINUM PASTE

(75) Inventors: Hiroyuki Wada, Mobara (JP); Junichiro Kogure, Mobara (JP); Masahiro Kato, Mobara (JP); Kazuhiko Itakura, Mobara (JP); Akio Namiki, Mobara (JP); Yoshinari Okamoto, Mobara (JP); Toshinori Suzuki, Mobara (JP)

(73) Assignee: Futaba Corporation, Mobara (JP)

( * ) Notice: Subject to any disclaimer, the term of this patent is extended or adjusted under 35 U.S.C. 154(b) by 0 days.

(21) Appl. No.: 09/334,745

(22) Filed: Jun. 17, 1999

(51) Int. Cl.[7] ..... H01J 1/62; H01J 63/04

(52) U.S. Cl. ..... 313/510; 313/496; 313/502; 313/495; 252/502; 252/508; 252/512

(58) Field of Search ..... 313/510, 495, 313/496, 497, 512, 502; 252/502, 503, 508, 510, 512, 519.3

(56) References Cited

U.S. PATENT DOCUMENTS

| | | | | | |
|---|---|---|---|---|---|
| 4,037,130 | A | * | 7/1977 | Mimitsuka et al. | 313/587 |
| 4,255,291 | A | * | 3/1981 | Needes et al. | 252/521.3 |
| 4,873,022 | A | * | 10/1989 | Ogawa et al. | 428/209 |
| 5,051,652 | A | * | 9/1991 | Isomura et al. | 313/479 |
| 5,198,154 | A | * | 3/1993 | Yokoyama et al. | 252/514 |
| 5,306,333 | A | * | 4/1994 | Dershem | 106/1.19 |
| 5,344,592 | A | * | 9/1994 | Wilczek et al. | 252/512 |
| 5,568,012 | A | * | 10/1996 | Mohri et al. | 313/517 |
| 5,689,153 | A | * | 11/1997 | Tanamachi | 313/586 |
| 5,705,097 | A | * | 1/1998 | Suzuki et al. | 252/514 |
| 5,939,823 | A | * | 8/1999 | Kiyomiya et al. | 313/495 |
| 6,111,353 | A | * | 8/2000 | Janning | 313/495 |
| 6,157,123 | A | * | 12/2000 | Schmid et al. | 313/422 |

FOREIGN PATENT DOCUMENTS

| | | | |
|---|---|---|---|
| JP | 07249389 A | * | 9/1995 |
| JP | 08031349 A | * | 2/1996 |
| JP | 2000123765 A | * | 4/2000 |

* cited by examiner

*Primary Examiner*—Vip Patel
*Assistant Examiner*—Kevin Quarterman
(74) *Attorney, Agent, or Firm*—Oblon, Spivak, McClelland, Maier & Neustadt, P.C.

(57) ABSTRACT

A fluorescent display device cable of being significantly increased in emission. A grid electrode is formed of a nonleaded conductive paste constituted by Al containing at least one of organic metal and phosphate glass frit by screen printing. This positively prevents precipitation of Pb on the grid electrode due to reduction of PbO by oxidation of Al during calcination of the conductive paste as encountered with the prior art.

2 Claims, 11 Drawing Sheets

FLUORESCENT DISPLAY DEVICE WITH CONDUCTIVE LAYER COMPRISING ALUMINUM PASTE

BACKGROUND OF THE INVENTION

This invention relates to a fluorescent display device, and more particularly to an aluminum paste used for a fluorescent display device constructed so as to permit a phosphor to emit light due to impingement of electrons thereon, a fluorescent display device including a conductive layer using such an aluminum paste and a method for manufacturing such a fluorescent display device.

Now, a conventional fluorescent display device which has been typically known in the art will be described with reference to FIGS. 6 and 7.

A conventional fluorescent display device generally designated at reference numeral 1 in FIG. 6 includes a box-like vacuum envelope 2 of which an interior is evacuated at a high vacuum and kept airtight. The vacuum envelope 2 includes an anode substrate 3 made of an insulating material, as well as a lid-like casing 6 formed of a front cover 4 made of an insulating and light-permeable material and a frame-like side plate 5 made of an insulating material.

The anode substrate 3, as shown in FIG. 7, is formed on an inner surface thereof positioned in the vacuum envelope 2 with a wiring 7 in a predetermined pattern corresponding to a display pattern 8. The wiring 7 is made of a thin aluminum film. The wiring 7 is then laminatedly formed thereon with an insulating layer 9. The insulating layer 9 is made of an insulating glass paste and deposited in the form of a thick film by printing. The insulating glass paste may be constituted of a powder of, for example, lead silicate glass, a powder of an inorganic material such as a heat-resistant pigment or the like, and a vehicle. The insulating layer 9 is formed at a portion thereof corresponding to each of segments 10 of the display pattern 8 with a through-hole 11, through which the wiring 7 is exposed. The through-holes 11 through which the wiring 7 is exposed each are filled with a conductive layer 12, which is formed of a conductive paste mainly consisting of Ag by printing.

The insulating layer 9, as shown in FIG. 7, is discretely formed thereon with an anode conductor 13 for every segment 10 of the display pattern 8 so that it may be electrically connected through the conductive layer 12 to the wiring 7. The anode conductors 13 thus discretely arranged each are provided thereon with a phosphor layer 14 so as to correspond in configuration to each of the segments 10 of the display pattern 8. The phosphor layer 14 is made of a phosphor paste consisting of a phosphor powder and a vehicle by printing. This permits an anode 15 to be provided for every segment 10 of the display pattern 8. A grid electrode 16 is arranged above the anodes 15 and filamentary cathodes 17 are then stretchedly arranged above the grid electrode 16.

In manufacturing of the conventional fluorescent display device 1 constructed as described above, an Ag—PbO glass paste prepared by mixing an Ag powder, a glass powder and a vehicle with each other at predetermined ratios is typically used as the paste for the conductive layer 12 for filling the through-hole 11 of the insulating layer 9. The paste may have a composition of 80 to 97% by weight in Ag powder and 3 to 20% by weight in PbO glass frit.

Manufacturing of the fluorescent display device 1 is started by forming the anodes 15 defining the display pattern 8 divided into a predetermined shape on the anode substrate 3. More particularly, an thin Al film is deposited on the anode substrate 15 and then subject to patterning by photolithography, so that the wiring 7 may be formed in correspondence to the display pattern 8.

Then, the insulating layer 9 provided with the through-holes 11 is formed on the Al wiring 7 by printing and then subject to calcination at a temperature of, for example, 550 to 600° C. Then, the through-holes 11 of the insulating layer 11 each are filled with the Ag—PbO glass paste described above, resulting in the conductive layer 12 being formed therein. Subsequently, a graphite paste is printed on the conductive layer 12, to thereby form the anode conductors 13, which are then subject to calcination at a temperature of, for example, 550 to 600° C. Then, the phosphor layer 14 is formed on each of the anode conductors 13 by printing and then subject to calcination at a temperature of 500° C. or below.

Thereafter, the anode substrate 3 on which the anodes 15 are thus formed is coated on an outer periphery thereof with a low-melting glass paste, which is then subject to calcination at 500° C. or below. Then, a mounting paste for fixing the mesh-like grid electrode 16 on the anode substrate 3 is coated on the anode substrate 3. Subsequently, the grid electrode 16 is arranged on the mounting paste, resulting in being fixed on the anode substrate 3.

Separately from the above-described operation, a frame which has the filamentary cathodes 17 stretched arranged thereon is assembled. The side plate 5 of the casing 6 is positioned at a bottom peripheral surface thereof on an outer periphery of the anode substrate 3 which is coated thereon with a low-melting paste. The anode substrate 3 and casing 6 are vertically pressed against each other and then subject to calcination at 500° C. or below, so that the outer periphery of the anode substrate 3 and the casing 6 may be sealed to each other, so that the vacuum envelope 2 may be assembled. Finally, the envelope 2 thus formed is evacuated at a high vacuum and then sealed, so that the fluorescent display device 1 may be completed.

In manufacturing of the fluorescent display device 1, as described above, the insulating layer 9 provided with the through-holes 11 is formed on the wiring 7 made of the thin Al film by printing. Formation of only one such insulating layer 9 causes pin holes to be formed in the insulating layer 9 due to intrusion of dust or the like thereinto during printing, so that the wiring 7 and anode conductor 13 are connected to each other through the pin holes, leading to deterioration in insulation. In order to avoid such a problem, printing of the insulating paste on the wiring is carried out twice, to thereby construct the insulating layer 9 into a two-layer structure, resulting in eliminating the above-described deterioration in insulation.

Now, a conventional fluorescent display device equipped with three-dimensional grids or stereogrids will be described hereinafter with reference to FIGS. 8 and 9 by way of example, wherein FIG. 8 generally shows the fluorescent display device and FIG. 9 shows an electrode structure incorporated in the fluorescent display device. The stereogrid-equipped fluorescent display device generally designated at reference numeral 100, as shown in FIG. 8, includes a vacuum envelope 200 of a box-like shape kept airtightly and at a high vacuum. The vacuum envelope 200 includes an anode substrate 300 and a lid-like casing 600. The lid-like casing 600 is formed of an anode substrate 300 made of an insulating material, a flat plate or front cover 400 made of an insulating and light-permeable material and a frame-like side plate 500 made of an insulating material. The substrates 300, 400 and 500 of the vacuum envelope 200 each are made of glass. The anode substrate 300 is sealedly mounted on an outer periphery thereof with the casing 600 by means of a sealing substance, resulting in the vacuum envelope being provided, which is then evacuated at a high vacuum.

The anode substrate 300, as shown in FIG. 9, is formed on an inner surface thereof with a wiring 700 in a predetermined pattern. The wiring 700 is made of a thin film of a conductive material such as Al or the like. The anode substrate 300 is formed thereon with an insulating layer 900 so as to cover the wiring 700. The insulating layer 900 is formed with through-holes 800, each of which is filled with a conductive material 110 such as, for example, Ag or the like.

Also, the fluorescent display device, as shown in FIG. 9, includes a conductive material such as graphite or the like arranged in the form of a segment 101 on the conductive material 110 in each of the through-holes 800, so that the materials each constitute an anode conductor 120. The anode conductors 120 each have a phosphor layer 130 deposited thereon in the form of the segment 101.

The fluorescent display device, as shown in FIGS. 8 and 9, also includes partitions 140 each made of an insulating material and formed around each of the phosphor layers 130. The partition 140 is arranged so as to surround the phosphor layer 130 and formed into a height larger than the phosphor layer 130. Such arrangement of the partition 140 permits an anode 150 to be provided while being partitioned for every segment. The segments 101 are integrally connected to each other by means of the partitions 140 for every display pattern 160.

The partitions 140 for every display pattern 160 are led out of each of the segments 101 by a predetermined distance so as to extend outwardly of the anode substrate 300. The partitions 140 for every display pattern 160 each are formed on a top thereof with a grid electrode 190, which is made of a conductive layer by printing, resulting in constituting a stereogrid 180.

Further, the fluorescent display device, as shown in FIG. 8, includes a plurality of filamentary cathodes 170 stretchedly arranged above the display pattern 160 in the vacuum envelope 200 while being rendered opposite to the display pattern 160. The filamentary cathodes 170 each are heated to emit electrons toward the display pattern 160 while being controlled.

The stereogrid-equipped fluorescent display device thus constructed permits division of the grid electrode at a close or crowded portion of the display pattern while preventing leakage luminescence, to thereby increase a degree of freedom of the display pattern, resulting in acceleration and interruption of the electrons being effectively controlled.

However, in each of the conventional fluorescent display devices described above, the wiring 7 or 700 is covered with an aluminum oxide film during calcination of the insulating layer 9 or 900, so that the fluorescent display device fails to provide satisfactory electrical connection between the wiring 7 or 700 and the anode conductor 13 or 120 due to the aluminum oxide film. Also, repeated calcination at a temperature of 550 to 600° C. causes separation of PbO from the Ag—PbO glass paste, resulting in a PbO glass film being formed on the wiring 7 or 700 or the anode conductor 13 or 120, leading to a failure in satisfactory electrical connection between the wiring 7 or 700 and the anode conductor 13 or 120 through the conductive layer 12 or 110.

In order to solve the problem, the assignee proposed that a conductive paste which functions to break the oxide film on the Al wiring 7 by a chemical reaction using an activator such as Zn, Sb or the like is used as the filler paste or the paste to be filled in the through-hole, as disclosed in Japanese Patent Application Laid-Open Publication No. 29414/1995 (Japanese Patent No. 2,677,161).

The conductive paste proposed is made by mixing an Ag powder, a glass powder and a vehicle with Zn and/or Sb in an amount of 1 to 20% added as an activator. Use of the conductive paste as the filler paste permits the oxide film on the Al wiring 7 to be broken by a chemical reaction, so that the paste may act as a catalyst for promoting alloying between Al in the wiring 7 and Ag in the conductive paste.

However, use of the conductive paste containing Zn and Sb in the form of an activator as the filler paste causes the activator contained in the conductive paste to excessively exhibit a chemical reaction because calcination at 550° C. or more is carried out several times during manufacturing of the fluorescent display device 1 shown in FIGS. 6 and 7. This results in the thin Al film being wholly corroded to decrease the conductive layer 12 in the through-hole 11, to thereby render the conductive layer 12 porous or spongy, leading to a failure in electrical connection.

Such a problem is likewise encountered with the stereogrid-equipped fluorescent display device shown in FIGS. 8 and 9 as well.

In the stereogrid-equipped fluorescent display device 100 shown in FIGS. 8 and 9, printing and drying are repeatedly carried out after formation of the insulating layer 900 by printing and calcination thereof, so that the partitions of a predetermined height and the phosphor layers 140 are formed, followed by calcination at a temperature of 550 to 600° C. Thus, the number of times of calcination at a temperature of 550 to 600° C. is increased as compared with that in the fluorescent display device shown in FIGS. 6 and 7, resulting in a failure in electrical connection being increased correspondingly.

In addition, the conventional conductive paste used as the filler paste mainly consists of Ag dissimilar to the wiring layer 700 made of a thin Al film, to thereby fail to exhibit satisfactory conformability to the wiring layer 700. Also, it is increased in cost as compared with the Al conductive paste.

Further, in the fluorescent display device shown in FIG. 7, the insulating layer 9 is colored black in order to increase contrast between the display pattern and a periphery thereof to enhance luminescence of the phosphor layer 14.

However, in general, a phosphor used for a fluorescent display device is nearly white. Thus, when the fluorescent display device shown in FIG. 6 is used as a vehicle-mounted display panel or a display panel for a gasoline station in an environment in which it is exposed to any external light increased in intensity such as sunlight or the like, the external light intrudes through a filter (not shown) arranged on a front surface of the front cover 4 into the vacuum envelope 2. This causes the segments 10 of the display pattern 8 which are kept turned off to be seen through due to a difference in contrast between the white phosphor layer 14 and the black insulating layer 9 and anode conductive layer 13.

Furthermore, the fluorescent display device shown in FIGS. 6 and 7 fails to restrain an increase in temperature thereof due to heat generated from the phosphor layer 14 during luminescence thereof, leading to a deterioration in luminance, because the conductive layer 13 is made of graphite increased in resistance to a level as high as 200 Ω/□. Also, such an increase in resistance of the conductive layer 13 renders formation of the anode conductive layer 13 in a fine pattern highly difficult or troublesome.

In recent years, a fluorescent display device which has a phosphor free of cadmium (Cd) incorporated therein has been demanded in the market in view of an environmental pollution problem. Such phosphors free of Cd (hereinafter referred to as "Cd-less phosphors") include, for example, $Ln_2O_2S$:Re and the like, wherein Ln is one selected from the group consisting of Y, Cd and La, and Re is Eu or Tb).

In the fluorescent display device shown in FIGS. 6 and 7, as described above, the conductive layer 13 formed by printing of a thick film is made of graphite increased in resistance as compared with Al and Ag. Also, the existing Cd-less phosphor is inherently increased in resistance. Thus, the Cd-less phosphor fails to emit light under a voltage as low as 150 V or less.

In view of the above, in the prior art, a conductive material mainly consisting of a $In_2O_3$ powder is mixed with the above-described Cd-less phosphor increased in resistance, to thereby reduce a resistance of the phosphor, leading to luminescence of the phosphor. Unfortunately, this fails to ensure uniform luminescence of the phosphor. Also, this causes the conductive material $In_2O_3$ to partially shield luminescence of the Cd-less phosphor, leading to a deterioration in luminance.

Moreover, in fabrication of the stereogrid 180 shown in FIGS. 8 and 9, an insulating paste of lead glass frit is subject to screen printing to form the partition 140, which is coated on a top thereof with a conductive paste prepared by mixing Al with lead oxide glass frit by screen printing, to thereby provide the grid electrode 190.

The lead oxide glass frit used for formation of the partition 140 may mainly consist of any one selected from the group consisting of $PbO—B_2O_3$, $PbO—B_2O_3—SiO_2$, $PbO—B_2O_3—ZnO$, $PbO—B_2O_3—ZnO—SiO_2$ and $PbO—SiO_2$. In other words, the glass frit may contain any one selected from the group in an amount of 70% or more. Also, the glass frit may further contain a flow preventing filler such as alumina, $TiO_2$ or the like. In addition, in the conductive paste for the grid electrode 190 which is a mixture of Al with lead glass frit, the Al powder may be in the form of a fine particle having an average particle diameter as small as about 1 to 10 $\mu$m and covered thereon with an oxide film.

Then, the partition 140 and grid electrode 190 thus formed by printing are concurrently subject to calcination at a temperature of, for example, 550 to 600° C., during which a radical combustion reaction takes place to melt the oxide film present on a surface of the conductive paste and then reduce PbO during oxidation of Al in the conductive paste, leading to precipitation of Pb. Also, the insulating paste used for formation of the partition 140 is made of lead oxide glass frit, so that precipitation of Pb is carried out at an interface between the partition 140 and the grid electrode 190 during oxidation of Al in the conductive paste as well.

The inventors carried out an experiment for confirming whether or not precipitation of Pb takes place in the conventional electrode structure. For this purpose, differential thermal analysis (TG-DTA) was carried out by subjecting the electrode structure to calcination at a rate of temperature rise of 10° C./min within a temperature range between 30° C. and 570° C. using a differential thermal analysis equipment manufactured by Mac Science. The results were as shown in FIGS. 10 to 12.

FIG. 10 shows results of differential thermal analysis carried out on a fine Al powder and indicates that a vigorous oxidation reaction took place at a temperature near 540° C. FIG. 11 shows results of differential thermal analysis on a paste within a temperature range between 30° C. and 570° C. The paste was obtained by mixing the fine Al powder with low-melting PbO glass frit to prepare a mixture and then calcining the mixture at a temperature of 570° C. once. FIG. 12 indicates that a peak by endothermic appeared at a temperature near 327.3° C. which is a melting temperature of Pb. Such results reveal that PbO was reduced during oxidation of Al in the conductive paste described above, leading to precipitation of Pb.

Such precipitation of Pb as described above causes the thus-precipitated Pb to be vaporized in the subsequent calcination step, resulting in being deposited on a surface of the filamentary cathodes 170. The calcination step includes a sealing step carried out at a temperature of 420 to 500° C. and an exhaust step at a temperature of 300 to 350° C. This causes Pb deposited on the surface of the filamentary cathodes 170 to be sintered to the surface when the filamentary cathodes 170 are driven for heating, leading to a deterioration in electron emission characteristics of the cathodes filamentary 170. Also, the stereogrid-equipped fluorescent display device thus deteriorated in emission characteristics causes a dark line which is a phenomenon that display just below the filamentary cathodes 170 is darkened to occur in 1000 hours, resulting in being deteriorated in life characteristics or durability of the fluorescent display device.

SUMMARY OF THE INVENTION

The present invention has been made in view of the foregoing disadvantage of the prior art.

Accordingly, it is an object of the present invention to provide an electrode structure for a fluorescent display device which is capable of exhibiting increased emission characteristics and durability.

It is another object of the present invention to provide a fluorescent display device which is capable of effectively establishing a distinction between a phosphor kept turned on and that kept turned off even in an environment in which it is irradiated with external light.

It is a further object of the present invention to provide a fluorescent display device which is capable of preventing a phosphor from being black-trimmed, leading to a deterioration in quality of display even in an environment in which external light is irradiated on the fluorescent display device.

It is still another object of the present invention to provide a fluorescent display device which is capable of restricting an increase in temperature of the fluorescent display device due to heat generated from a phosphor during luminescence thereof, to thereby ensure an increase in luminance.

It is yet another object of the present invention to provide a fluorescent display device which is capable of attaining formation of a fine pattern.

It is even another object of the present invention to provide a fluorescent display device which is capable of ensuring uniform luminescence of a phosphor under a low voltage while preventing a deterioration in emission characteristics thereof even when a phosphor increased in resistance is used.

It is a still further object of the present invention to provide a fluorescent display device which is capable of ensuring positive electrical connection between a wiring and an anode conductor.

It is a yet further object of the present invention to provide a method for manufacturing a fluorescent display device which is capable of providing a fluorescent display device attaining the above-described objects.

In accordance with one aspect of the present invention, an aluminum paste for a fluorescent display device is provided which is deposited on a glass substrate constituting a part of a vacuum envelope of the fluorescent display device, to thereby function as a conductive layer. The aluminum paste includes an aluminum powder acting as a conductive material, at least one of low-softening frit glass and organic metal acting as a fixing ingredient, and a vehicle acting as a viscous ingredient.

In a preferred embodiment of the present invention, the aluminum powder, low-softening frit glass and vehicle which are mixed with each other are 40 to 80%, 3 to 40% and 15 to 30% in amounts, respectively.

In a preferred embodiment of the present invention, the aluminum powder, low-softening frit glass and vehicle which are mixed with each other are 60 to 80%, 3 to 25% and 15 to 25% in amounts, respectively.

In a preferred embodiment of the present invention, low-softening frit glass is lead oxide (PbO) frit glass.

In a preferred embodiment of the present invention, low-softening frit glass is phosphate frit glass.

In a preferred embodiment of the present invention, low-softening frit glass is bismuth oxide ($Bi_2O_3$) frit glass.

In a preferred embodiment of the present invention, organic metal is an organic titanium (Ti) compound.

In a preferred embodiment of the present invention, aluminum powder has an average particle diameter of 1 to 10 $\mu$m.

In accordance with another aspect of the present invention, a fluorescent display device is provided. The fluorescent display device includes a vacuum envelope kept at a high vacuum therein, an aluminum wiring arranged in the vacuum envelope, an insulating layer formed with through-holes and arranged so that the through-holes each are positioned on the aluminum wiring in the vacuum envelope, conductive layers filled in the through-holes in the vacuum envelope, respectively, an anode conductor made of a conductive layer and formed on each of the through-holes in the vacuum envelope, a phosphor layer deposited on an upper surface of each of the anode conductors in the vacuum envelope, and a grid arranged opposite to the phosphor layer in the vacuum envelope. Any of the conductive layers is formed by deposition and calcination of the aluminum paste prepared as described above, wherein the frit glass and/or an oxide of the metal acting as the fixing ingredient is fixed by the aluminum acting as the conductive ingredient.

In a preferred embodiment of the present invention, the insulating layer formed with the through-holes is colored black. The anode conductors formed on the insulating layer each mainly consist of aluminum and are colored white.

In a preferred embodiment of the present invention, the insulating layer formed with the through-holes is colored white. The anode conductors formed on the insulating layer each mainly consist of aluminum and are colored black.

In a preferred embodiment of the present invention, the phosphor layer is formed into a size smaller than the white anode conductor, resulting in the conductive layer white being exposed on a periphery of the phosphor layer.

Further, in accordance with this aspect of the present invention, a fluorescent display device is provided. The fluorescent display device includes stereogrids each including a partition made of an insulating material and arranged so as to surround a phosphor layer deposited on each of anode conductors and a grid section formed of a conductive layer by printing and arranged on a top of the partition. The grid section is formed by deposition and calcination of an aluminum paste containing phosphate frit glass or bismuth oxide frit glass, resulting in containing a conductive material constituted by aluminum and a fixing ingredient constituted by a metal oxide prepared by calcining the phosphate or bismuth oxide frit glass and/or organic metal.

In a preferred embodiment of the present invention, the fluorescent display device also includes an intermediate layer arranged between the partition of each of the stereogrids and the conductive layer thereof. The intermediate layer mainly consists of a metal oxide prepared by calcination of phosphate or bismuth oxide frit glass, or organic metal.

In a preferred embodiment of the present invention, the fluorescent display device also includes an intermediate layer arranged between the partition of each of the stereogrids and the conductive layer thereof. The intermediate layer mainly consists of phosphate frit glass. The intermediate layer during calcination of the stereogrid has a softening point set to be higher than a sintering temperature of the grid section and a sintering temperature set to be lower than a softening point of the partition.

In a preferred embodiment of the present invention, the insulating material for the partition mainly consists of phosphate or bismuth oxide frit glass.

In a preferred embodiment of the present invention, the conductive layer for the grid section contains phosphate or bismuth oxide frit glass identical with that the phosphate or bismuth oxide frit glass for the insulating material.

In accordance with a further aspect of the present invention, there is provided a method for manufacturing a fluorescent display device which includes stereogrids each including a partition made of an insulating material and arranged so as to surround a phosphor layer on each of anode conductors arranged in a display pattern and a grid section formed of a conductive layer on a top of the partition. The method includes the step of printing an insulating paste so as to surround each of the phosphor layers to form each of the partitions. The insulating paste is made of an insulating material mainly consisting of low-softening frit glass. The method also includes the step of printing a conductive paste on the top of each of the partitions to form each of the grid sections. The conductive paste contains a fixing ingredient constituted by at least one of a metal oxide and frit glass and a conductive material constituted by aluminum.

In a preferred embodiment of the present invention, the conductive paste is an aluminum paste containing phosphate frit glass or bismuth oxide frit glass.

In a preferred embodiment of the present invention, the partition is made of an insulating paste mainly consisting of phosphate frit glass or bismuth oxide frit glass. The grid section contains a conductive material constituted by aluminum and a fixing ingredient containing frit glass identical with the frit glass for the partition.

In a preferred embodiment of the present invention, the method further includes the step of forming an intermediate layer between the partition and the grid section.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, in which like reference numerals designate like or corresponding parts throughout; wherein.

DETAILED DESCRIPTION OF THE PREFERRED EMBODIMENTS

Now, the present invention will be described hereinafter with reference to the accompanying drawings.

Figure 1:
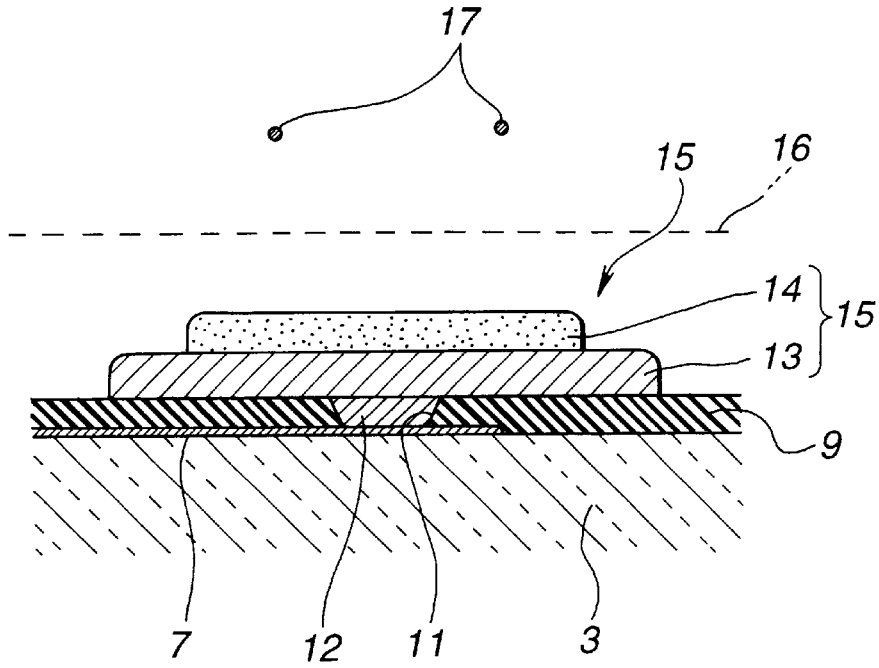
FIG. 1 is a fragmentary enlarged sectional view showing a first embodiment of a fluorescent display device according to the present invention.

Referring first to FIG. 1, a first embodiment of a fluorescent display device according to the present invention is illustrated. In a fluorescent display device of the illustrated embodiment, an insulating layer 9 is formed thereon with conductive layers (anode conductors) 13 of a substantially white color by filling a thick film in through-holes 11 of the insulating layer 9 by printing while being individually or discretely arranged for every segment of a display pattern, so that the conductive layers 13 may be electrically connected to a wiring 7.

The conductive layers 13 thus formed of a thick film by printing each are made of a conductive paste mainly consisting of an Al powder in which a glass powder and a vehicle such as, for example, an ethyl cellulose vehicle are incorporated. The glass powders include colorless transparent lead-free or nonleaded glass of about 5 $\mu$m in particle diameter which does not contain any pigment, low-melting glass and the like. The conductive paste has a composition of 40 to 80% in Al powder, 3 to 40% in glass powder and 15 to 30% in vehicle.

The amount of Al powder is preferably within a range of 60 to 65%. More specifically, the conductive paste used may have a composition of 63.4% in Al powder, 11.2% in glass powder and 25.4% in vehicle by way of example.

The conductive layers 13 each are formed thereon with a phosphor layer 14, to thereby provide an anode 15. The phosphor layer 14 is formed into a size larger than the conductive layer 13 in order to eliminate any possible display defect at an end thereof due to charging of electrons on the insulating layer 9.

The remaining part of the illustrated embodiment may be constructed in substantially the same manner as the prior art described above.

Figure 2:
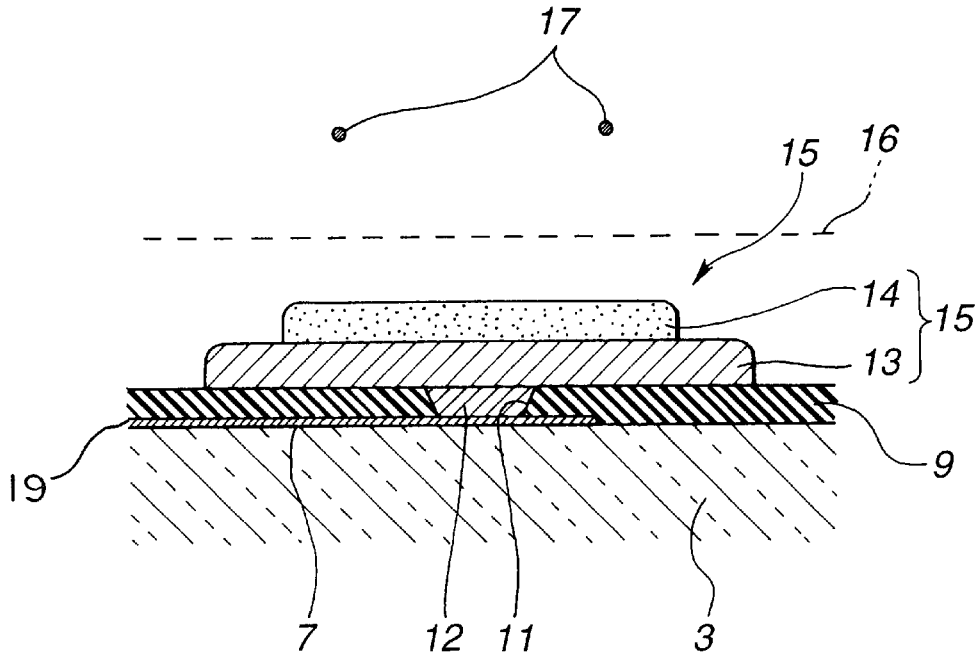
FIG. 2 is a fragmentary enlarged sectional view showing a second embodiment of a fluorescent display device according to the present invention.

Referring now to FIG. 2, a second embodiment of a fluorescent display device according to the present invention is illustrated. A fluorescent display device of the illustrated embodiment may be constructed in substantially the same manner as the first embodiment described above, except that an insulating layer 19 is colored black.

In the illustrated embodiment, the insulating layer 19 is formed of a thick film of an insulating glass paste by printing. The insulating glass paste may be constituted by, for example, a powder of lead silicate glass, a powder of an inorganic material such as a heat-resistant black pigment, and a vehicle.

Now, manufacturing of each of the fluorescent display devices thus constructed will be described.

First, the anodes 15 arranged in the display pattern divided in a predetermined shape are formed on the anode substrate 3. More specifically, the thin Al film is subject to patterning on the anode substrate 3, resulting in the wiring 7 being formed in correspondence to the display pattern.

Then, the insulating layer 9 formed with the through-holes 11 is formed on the wiring 7 by printing. At this time, in manufacturing of the fluorescent display device of the first embodiment, a thick film of an insulating paste mainly consisting of $TiO_2$ is formed on the wiring 7 by printing, to thereby provide the white insulating layer 9 formed with the through-holes 11, followed by calcination of the insulating layer 9. In manufacturing of the fluorescent display device of the second embodiment, an insulating glass paste consisting of a powder of lead silicate glass, a powder of an organic material such as a heat-resistance black pigment or the like and a vehicle is printed in the form of a thick film on the wiring 7, to thereby provide the black insulating layer 19 formed with the through-holes 11, followed by calcination of the insulating layer 19.

Then, the through-holes 11 of the insulating layer 9 or 19 are each filled with the conductive material of the Al paste. Then, the conductive paste mainly consisting of the Al powder in which the glass powder and the vehicle such as a cetyl cellulose vehicle are incorporated is printed in the form of a thick film on each of the through-holes 11, to thereby provide the conductive layer 13 of a substantially white color, followed by calcination thereof at a temperature of 550 to 600° C. Thereafter, the phosphor layer 14 is formed on each of the conductive layers 13 by printing and then subject to calcination, to thereby provide the anode 15.

Subsequently, the anode substrate 3 on which the anodes 13 are thus formed is coated on an outer periphery thereof with a low-melting glass paste and then calcined. Then, a mounting paste for fixing the control electrode on the anode substrate 3 is coated on the anode substrate 3. Then, the control electrode 6 is arranged on the mounting paste, resulting in being fixedly mounted on the anode substrate 3 through the mounting paste.

Separately from the above-described operation, a frame on which filamentary cathodes 17 are stretchedly arranged is assembled. A side plate 5 of a casing 6 is positioned at a bottom peripheral surface thereof on an outer periphery of the anode substrate 3 which is coated thereon with the low-melting paste as described above. The anode substrate 3 and casing 3 are vertically pressed against each other, so that the outer periphery of the anode substrate 3 and the casing 6 may be sealed to each other, resulting in assembling a vacuum envelope 2. Then, the vacuum envelope 2 thus formed is evacuated at a high vacuum and then sealed, so that the fluorescent display device may be completed.

In each of the embodiments described above, the phosphor layer 14 formed on each of the conductive layers 13 by printing may be made of a low-resistance phosphor conventionally used such as ZnO:Zn or the like, as well as a phosphor free of cadmium.

The phosphors free of cadmium include high-resistance phosphors such as an $Ln_2O_2S$:Re phosphor, wherein Ln is one selected from the group consisting of Y, Gd and La, and Re is Eu or Tb; sulfide phosphors such as ZnS:Zn or ZnS:Cu,Al and (Zn,Cd)S:Ag,Cl, (Zn,Cd)S:Au,Al, (Zn,Cd)S:Ag,Al and the like; $ZnGa_2O_4$ phosphors such as, for example, $ZnGa_2O_4$:Mn, $ZnGa_2O_4$:Li,Mg and $ZnGa_2O_4$:Cr; and the like.

The inventors manufactured a fluorescent display device using each of high-resistance $Ln_2O_2S$:Eu, $Gd_2O_2S$:Eu and $Y_2O_3$:Eu phosphors according to the procedure described above. As a result, it was confirmed that the phosphors each start to emit light under a voltage as low as about 20 V and is increased in luminance with an increase in voltage. Also, substantially the same results as those obtained in connection with the conductive layer made of graphite were obtained in connection with other phosphors.

The fluorescent display device of each of the embodiments thus constructed exhibits various significant advantages.

More particularly, the fluorescent display device of the first embodiment permits the whole background on the anode substrate 3 including a periphery of the phosphors which is observed through the front cover 4 to be rendered substantially white. This prevents the segments of the display pattern of the phosphors kept turned off and a periphery thereof from being seen through from an outside of the fluorescent display device, to thereby enhance observability of display of the fluorescent display device, even when the fluorescent display device is mounted in the from of an instrument display panel on a vehicle or installed outdoors as a display unit for a measuring meter in a gasoline station.

The electrode which is the conductive layer 13 is whitish, to thereby be decreased in absorption of light as compared with the conventional graphite conductive layer. This permits a part of light to be reflected by the conductive layer 13, leading to an increase in luminance Also, the fluorescent display device is advantageous when luminance of the phosphor is insufficient, so that a filter arranged on the front cover 4 may be reduced in thickness.

The conductive layer 13 is formed of a conductive material mainly consisting of Al of 30 mΩ/□ in resistance reduced as compared to a resistance of graphite for the conventional conductive layer, to thereby significantly restrain generation of heat from the conductive layer. This effectively prevents a reduction in luminance due to an increase in temperature in the vacuum envelope 2 owing to the above-described heat generation.

Also, the thick Al film electrode reduced in resistance is used for the conductive layer 13, to thereby eliminate arrangement of any conductive member for reducing a resistance of the conductive layer which is required in the prior art. This permits uniform luminescence of phosphors increased in resistance such as $Ln_2O_2S$:Re phosphors, a ZnS:Zn or ZnS:Cu,Al sulfide phosphor, and $ZnGa_2O_4$ phosphors under a voltage as low as about 20 to 150 V, so that the phosphors may be effectively applied to the fluorescent display device of the present invention.

Further, the conductive layer 13 made of an Al electrode fixed due to melting and solidification of a glass powder is reduced in specific surface area, to thereby be reduced in gas adsorption as compared with the conventional conductive layer made of the graphite electrode, so that electron emission characteristics of the cathodes 17 may be enhanced.

A variety of phosphors including a phosphor reduced in resistance such as a ZnO:Zn phosphor conventionally used each may be used as the phosphor for the phosphor layer 14 arranged on each of the conductive layers 13. At this time, when the phosphor reduced in resistance is used for the phosphor layer 14, it contributes to a further increase in luminance as compared with the phosphor increased in resistance. Also, this eliminates a necessity of selectively using the conventional graphite conductive layer and the phosphor layer 14, so that the fluorescent display device of the embodiment may be manufactured without increasing the number of steps in the manufacturing.

Now, the aluminum paste of the present invention and the second embodiment will be described in detail.

The filler paste used in the fluorescent display device of the second embodiment is constituted by an Al conductive paste which mainly consists of an Al powder, in which at least one of low-softening glass frit and organic metal is contained.

The term "organic metal" used herein means a compound having a carbon-metal bond. The organic metals include, for example, organic aluminum compounds such as trialkyl aluminum, triaryl aluminum and the like; organic silver compounds such as methyl silver, propyl silver, phenyl silver and the like; organic chromium compounds such as triphenyl chromium tris, bisbenzene chromium and the like; organic silicon compounds such as organosilane, organosilazane, organosiloxane and the like; organic cobalt compounds such as aryl cobalt halide, bil-cobalt bromide and the like; organic tin compounds such as dialkyl tin, diaryl tin, tetraalkyl tin and the like; organic tungsten compounds such as tungsten phenoxide, bis-hexacarbonyl-ditungsten and the like; organic copper compounds such as methyl copper, phenyl copper and the like; organic lead compounds such as tetralkyl lead, tetranyl lead and the like; and organic nickel compounds such as bis (cyclopentadienyl) nickel and the like. Organic titanium compounds include, for example, alkyl titanium compounds such as bis-titanium dihalide, bis-titanium, titanosene, titanium tetraalkoxide and the like.

More specifically, the Al conductive paste may be constituted by any one selected from the group consisting of a mixture of a fine Al powder with low-softening glass frit and a vehicle, a mixture of a fine Al powder with an organic Ti compound acting as organic metal and a vehicle, a mixture of a fine Al powder with low-softening glass frit, an organic Ti compound and a vehicle.

When the Al conductive paste thus obtained by mixing the fine Al powder, low-softening glass frit and vehicle with each other is used as the filler paste, it may have a composition of, for example, 40 to 80% in fine Al powder, 3 to 40% in low-softening glass frit and 15 to 30% in vehicle.

When the Al conductive paste constituted by the mixture of the fine Al powder, organic Ti compound and vehicle is used as the filler paste, it may have a composition of, for example, 60 to 80% in fine Al powder, 3 to 25% in organic Ti compound and 15 to 30% in vehicle.

When the Al conductive paste constituted by the mixture of the fine Al powder, low-softening glass frit and organic Ti compound is used as the filler paste, it may have a composition of, for example, 40 to 80% in fine Al powder, 3 to 40% in low-softening glass frit and 3 to 25% in organic Ti compound.

When the fine Al powder which is a major component of the filler paste is excessively reduced in average particle diameter, it agglomerates, to thereby exhibit properties like alumina, resulting in failing to permit an oxide film on a surface thereof to be broken at a low temperature of 550 to 600° C. Thus, the fine Al powder may be obtained by nitrogen-atomizing wherein liquid Al is injected into a nitrogen atmosphere to form a fine Al powder. The nitrogen-atomizing techniques provide a fine Al powder of 1 to 10 $\mu$m and preferably 2 to 5 $\mu$m in average particle diameter. The fine Al powder thus nitrogen-atomized permits an oxidation reaction to occur at a temperature as low as about 540° C., leading to breakage of an oxide film on the surface of the Al particle and an oxide film on the Al wiring layer 7, resulting in ensuring satisfactory electrical connection between the wiring layer 7 and the anode conductor 13. The oxidation reaction is kept from excessively proceeding even when the calcination is repeated at a temperature of 550 to 600° C., so that the electrical connection may be effectively ensured.

The low-softening glass frit contained in the Al conductive paste or filler paste is glass having a softening point of 300 to 400° C. The low-softening glass frits include, for example, PbO glass, phosphate glass, $Bi_2O_3$ glass and the like.

The vehicle contained in the Al conductive paste is required for screen printing of the conductor in a predetermined pattern and constituted by a viscous liquid prepared by dissolving an organic solvent in an organic high-molecular substance. Thus, the vehicle is removed from the system during the calcination.

Now, a stereogrid-equipped fluorescent display device will be described hereinafter with reference to FIGS. 3 and 4.

Figure 3:
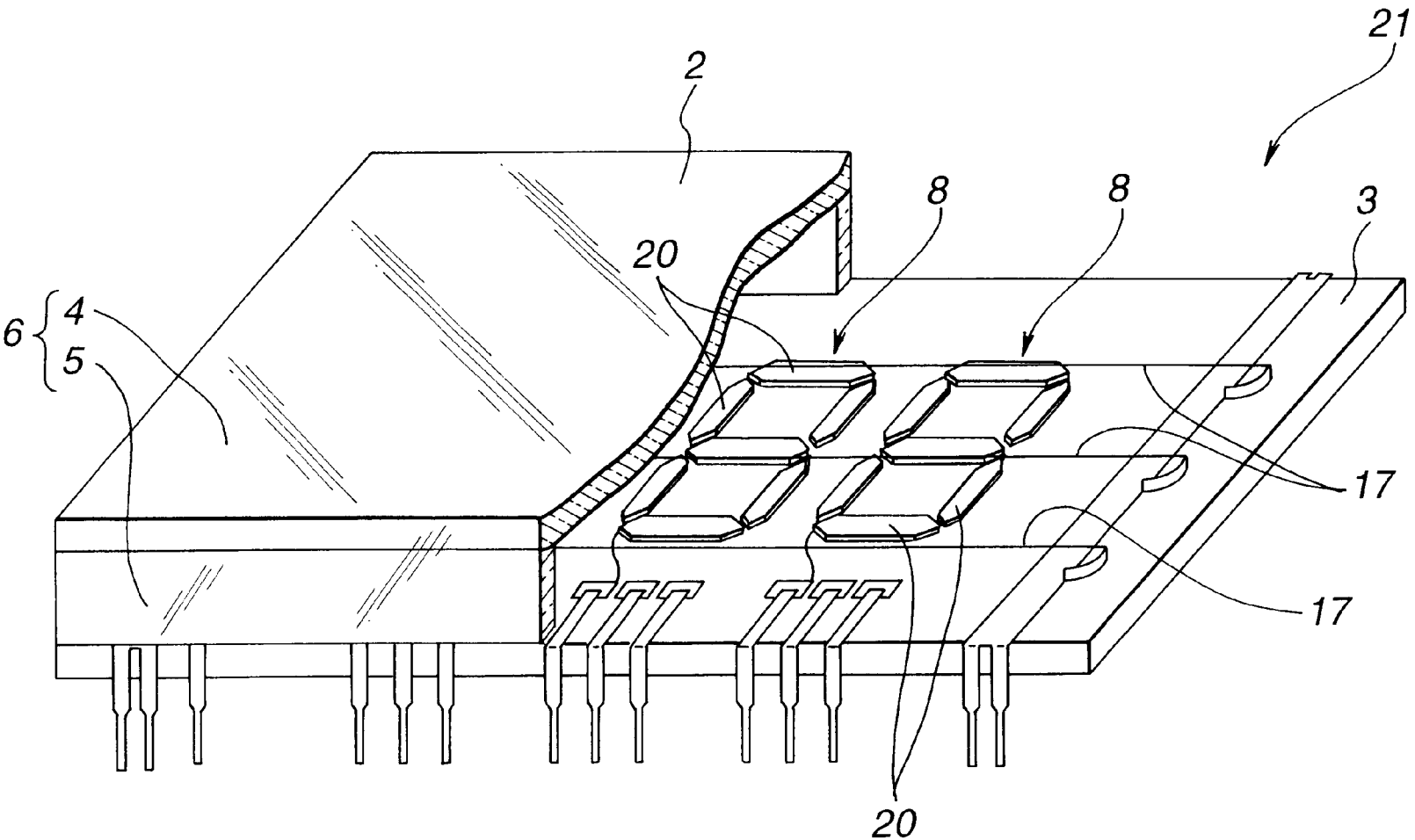
FIG. 3 is a partially cut-away perspective view generally showing a fluorescent display device according to the present invention.

A stereogrid-equipped fluorescent display device generally designated at reference numeral 21 in FIG. 3 includes a box-like vacuum envelope 2 evacuated at a high vacuum and kept airtight. The vacuum envelope 2 includes an anode substrate 3 made of an insulating material, as well as a lid-like casing formed of a front cover 4 made of an insulating and transparent material and a frame-like side plate 5 made of an insulating material. In the vacuum envelope 2 thus formed, the substrates 2, 3 and 4 each are made of glass. The casing 6 is sealedly mounted on an outer periphery of the anode substrate 3 by means of a sealing material, to thereby provide the envelope 2, which is then evacuated at a high vacuum and sealed.

Figure 4:
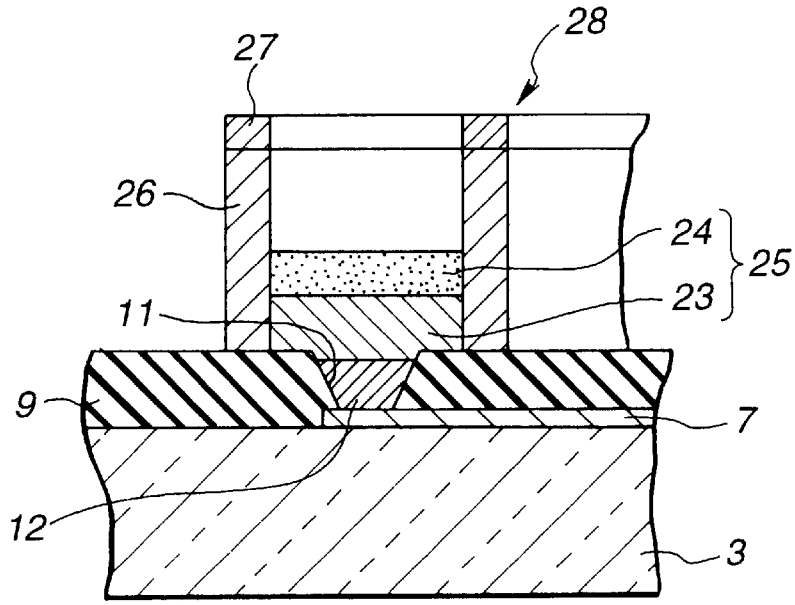
FIG. 4 is a fragmentary enlarged sectional view showing an embodiment of a stereogrid-equipped fluorescent display device according to the present invention.

The anode substrate 3, as shown in FIG. 4, is formed on an inner surface thereof with a wiring 7 (anode wiring layer, grid wiring layer) in a predetermined pattern. The wiring 7 is made of a thin Al film which is a conductive material. The anode substrate 3 is formed thereon with an insulating layer 9 formed with through-holes 11 so as to cover the Al wiring 7. The through-holes 11 of the insulating layer 9 each are filled with a conductive layer 12 formed of the above-described Al conductive paste by printing.

The conductive layer 12 filled in each of the through-holes 11 has a conductive paste printed in the form of each of segments 20 of each of display patterns 8, to thereby provide an anode conductor 23 in the form of a conductive layer. The anode conductor 23 is provided thereon with a phosphor layer 24 in the form of each of the segments 20 of the display pattern 8.

The phosphor layers 24, as shown in FIG. 4, each are provided therearound with a partition 26, which is formed of an insulating paste by printing. The partition 26 is formed into a height larger than that of the phosphor layer 24 while enclosing the phosphor layer 24. The segments 20 are connected to each other through the partitions 26 for every display pattern 8.

The partitions 26 for every display pattern 8, as shown in FIG. 4, each are led out of each segment 20 so as to extend by a predetermined distance toward an outside of the anode substrate 3. The partitions 26 for every display pattern 8 each are formed on a top thereof with a grid electrode 27 by printing, to thereby provide a stereogrid 28. The grid electrode 27 is constituted by a conductive layer formed of an Al paste by printing.

The stereogrid-equipped fluorescent display device 21, as shown in FIG. 3, also includes filamentary cathodes 17 stretchedly arranged above the display patterns 8 in the vacuum envelope 2 in a manner to be opposite to the display patterns 8. The cathodes 17 are heated to emit electrons toward the display patterns 8 while being controlled.

Now, manufacturing of the stereogrid-equipped fluorescent display device 21 thus constructed will be described hereinafter.

First, the wiring layer (anode wiring layer, grid wiring layer) 7 is formed of the thin Al film on the anode substrate 3 by photolithography. Then, the insulating layer 9 formed with the through-holes 11 is arranged on the anode substrate 3 by printing so as to cover the Al wiring 7.

At this time, formation of the insulating layer 9 by printing is so carried out that the through-holes 11 are positioned at connections among the segments 20 of each of the display segments 8, the grid electrodes 27 and the grid wirings (not shown), respectively. Then, the insulating layer 9 is subject to calcination at a temperature of, for example, 550 to 600° C.

Then, the through-hole 11 positioned at each of the segments 20 is filled with the Al conductive paste or filler paste by printing, to thereby form the conductive layer 12, which is then dried. Concurrently, the through-holes positioned at connections between the grid electrodes 28 and the grid wiring (not shown) each are filled with the Al conductive paste or filler paste by printing, followed by drying of the paste. Then, the insulating layer 9 acting as a second layer is formed by printing and then calcined at a temperature of, 550 to 600° C.

Subsequently, the conductive layer 10 with which the through-hole 11 has been filled has the Al paste printed in the form of the segment 20, resulting in the anode conductor 23 being provided. Then, the partition 26 is formed of the insulating paste into a predetermined width by printing. This results in the anode 20 partitioned for every segment 20 being provided. Concurrently, lead-out partitions (not shown) and grid connection partitions (not shown) are formed by printing in the same procedure. Then, the anode conductor 23 is formed thereon with the phosphor layer 24 in the shape of the segment 20 by printing. Then, calcination is carried out at a temperature of 500° C. or below.

Formation of the partition 26 by printing of the insulating paste is carried out by repeating the printing and drying plural times, because a height of the partition obtained by one-time printing is insufficient for the partition 26 desired. This permits the partition arranged for every segment 20 and the lead-out partition and grid connection partition to be concurrently formed into a predetermined height by printing.

Thereafter, the partition 26 for every segment 20 (including the lead-out partition and grid connection partition (not shown)) has the Al paste printed on a top thereof, to thereby provide the grid electrode 27. Such printing of the Al paste concurrently forms electrical connection between the grid electrode 27 and the grid wiring (not shown), followed by calcination of the Al paste at a temperature of, for example, 550 to 600° C.

Separately from the above operation, a frame on which the filamentary cathodes 17 are stretchedly arranged is assembled as in manufacturing of the fluorescent display device 21 shown in FIG. 3. Then, the side plate 5 of the casing 6 is positioned at a bottom peripheral surface thereof on an outer periphery of the anode substrate 3 on which a low-melting paste is coated. Then, the anode substrate 3 and casing 6 are vertically pressed against each other and then calcined at 500° C. or below, to thereby be sealed to each other, resulting in the vacuum envelope 2 being assembled. Then, the vacuum envelope 2 is evacuated at a high vacuum and then sealed, thus, the stereogrid-equipped fluorescent display device 21 may be finished.

Thus, in the illustrated embodiment, the filler paste used for filling each of the through-holes 11 of the insulating layer to provide the conductive layer 12 is constituted by the conductive paste mainly consisting of Al which is the same metal as that for formation of the wiring 7. Thus, the conductive layer 7 exhibits increased conformability to the wiring 7, to thereby ensure electrical connection between the wiring 7 and the anode conductor 12.

The conventional conductive paste such as Ag—PbO glass paste or Ag conductive paste containing Zn or Sb as an activator and the Al conductive paste of the illustrated embodiment each were used as the filler paste and subject to calcination at 560° C. once. As a result, it was found that the conventional Ag—PbO glass paste exhibits fraction defective as high as 5%, whereas the Al conductive paste of the illustrated embodiment permits fraction defective to be reduced to a level of 0%. Also, in calcination carried out at 560° C. three times, the activator-containing Ag conductive paste exhibited fraction defective as high as 50%, whereas the Al conductive paste of the illustrated embodiment reduced fraction defective fraction to 0%.

Al contained as a major component in the conductive paste of the illustrated embodiment is constituted by the fine Al powder of 1 to 10 $\mu$m in average particle diameter which was nitrogen-atomized, so that the oxidation reaction may take place at a temperature as low as about 540° C., leading to breakage of both the oxide film on the surface of the Al particle and the oxide film on the Al wiring layer 7, to thereby establish satisfactory electrical connection between the wiring layer 7 and the anode conductor 13. Also, the reaction is kept from excessively proceeding irrespective of repeated calcination at 550 to 600° C., so that electrical connection between the wiring layer 7 of the thin Al film and the anode conductor 13 may be effectively kept.

Further, the conductive paste of the illustrated embodiment containing Al as a major component is reduced in cost and exhibits a stable resistance, as compared with the conductive paste containing Ag as a major component, so that the fluorescent display device of the illustrated embodiment may be significantly reduced in cost as compared with the prior art.

Now, third and fourth embodiments of a fluorescent display device according to the present invention will be described hereinafter with reference to FIGS. 4 and 5, respectively.

FIG. 4 shows an electrode structure incorporated in a third embodiment of a stereogrid-equipped fluorescent display device according to the present invention. The electrode structure shown in FIG. 4 is so constructed that a grid electrode 27 is formed on a top of each of partitions 26 arranged on an insulating layer 9, to thereby provide a stereogrid 28.

The grid electrode 27 is formed of an Al conductive paste free of PbO glass frit and containing at least one of organic metal and phosphate glass frit by screen printing. More specifically, the conductive materials for formation of the grid electrode 27 by printing include a material obtained by mixing Al with an organic Ti compound and a vehicle, that obtained by mixing Al with $P_2O_5$ glass frit and a vehicle, and that obtained by mixing Al with an organic Ti compound, $P_2O_5$ glass frit and a vehicle.

When a conductive paste obtained by mixing Al with an organic Ti compound and a vehicle is used as the Al conductive paste, it may have a composition of 60 to 80% in fine Al powder, 3 to 25% in organic Ti compound and 15 to 25% in vehicle. When a conductive paste prepared by blending Al with $P_2O_5$ glass frit and a vehicle is used for formation of the grid electrode 27, it may have a composition of 40 to 80% in fine Al powder, 3 to 40% in $P_2O_5$ glass frit and 15 to 30% in vehicle.

The vehicle is required for screen-printing of the grid electrode in a predetermined pattern. It is in the form of a viscous liquid obtained by dissolving an organic high-molecular substance in an organic solvent. Thus, the vehicle is vaporized during calcination.

Figure 5:
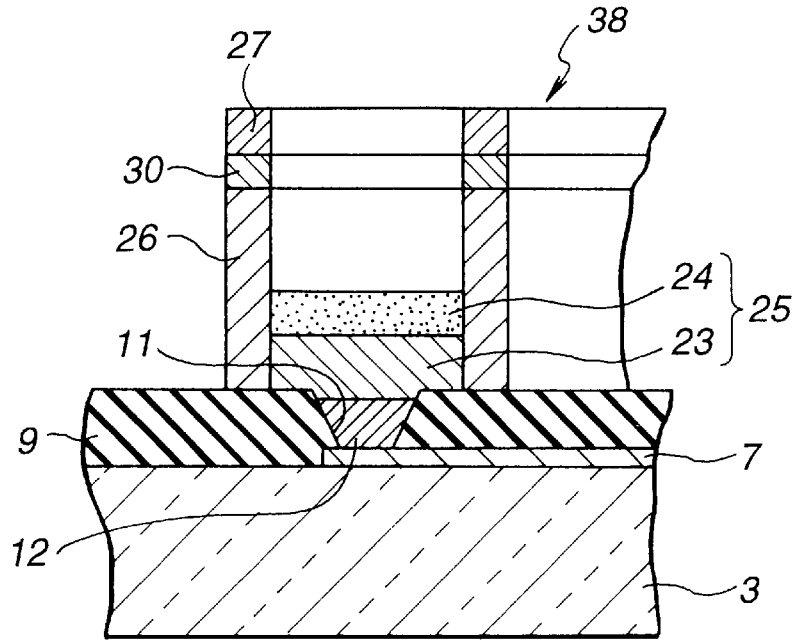
FIG. 5 is a fragmentary enlarged sectional view showing another embodiment of a stereogrid-equipped fluorescent display device according to the present invention.
Figure 6:
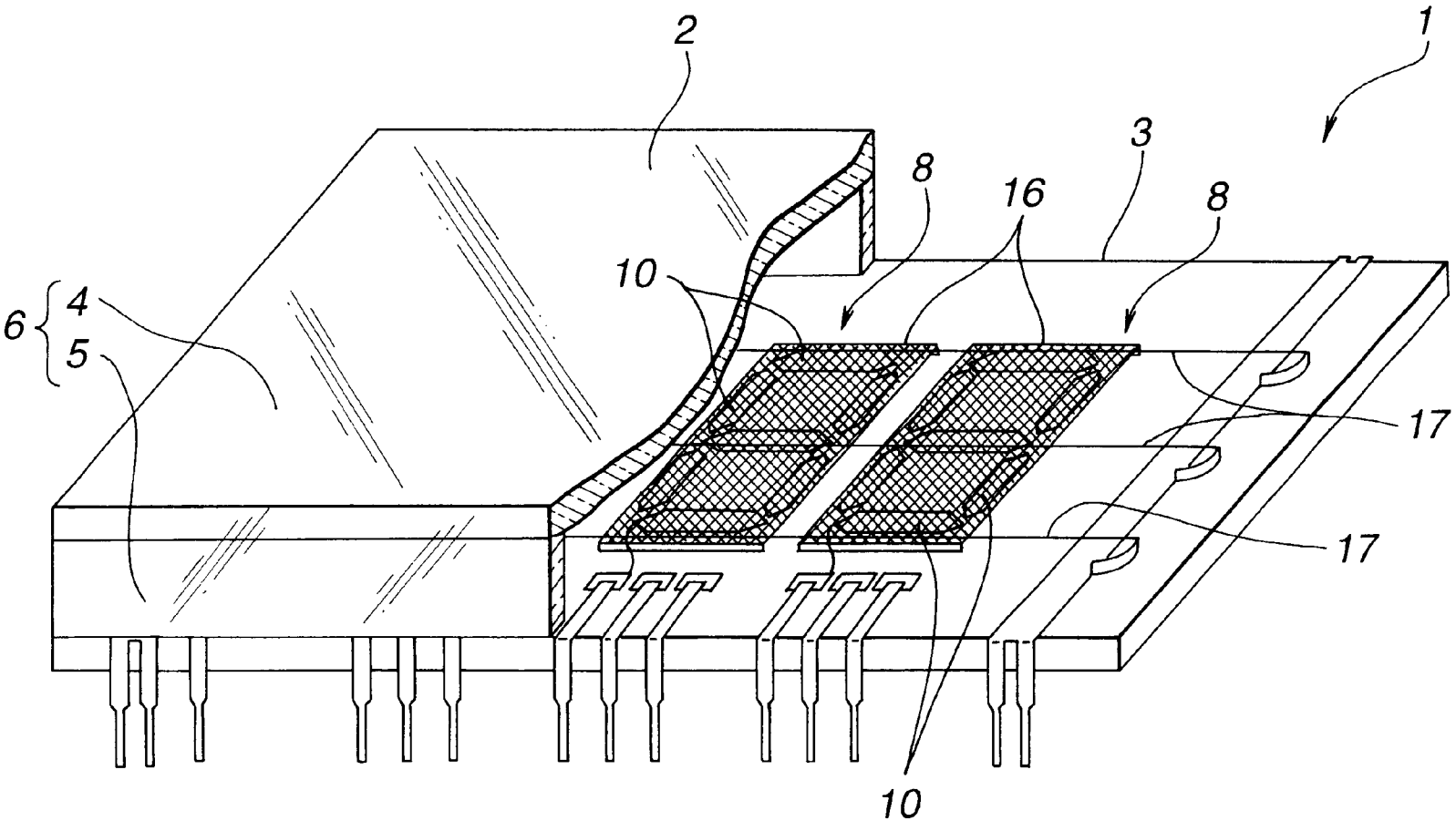
FIG.6 PRIOR ART
FIG. 6 is a partially cut-away perspective view generally showing a conventional fluorescent display device.
Figure 7:
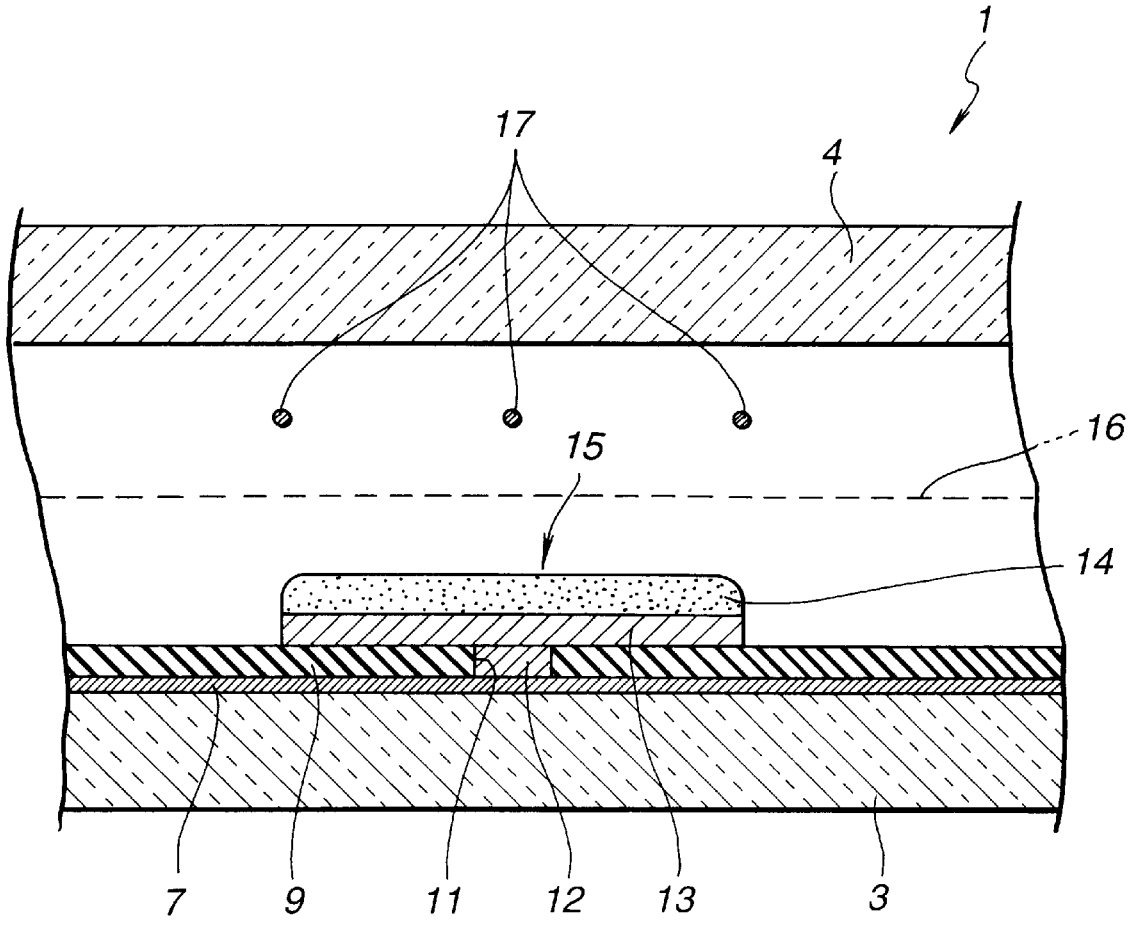
FIG.7 PRIOR ART
FIG. 7 is a fragmentary enlarged sectional view showing a conventional fluorescent display device.
Figure 8:
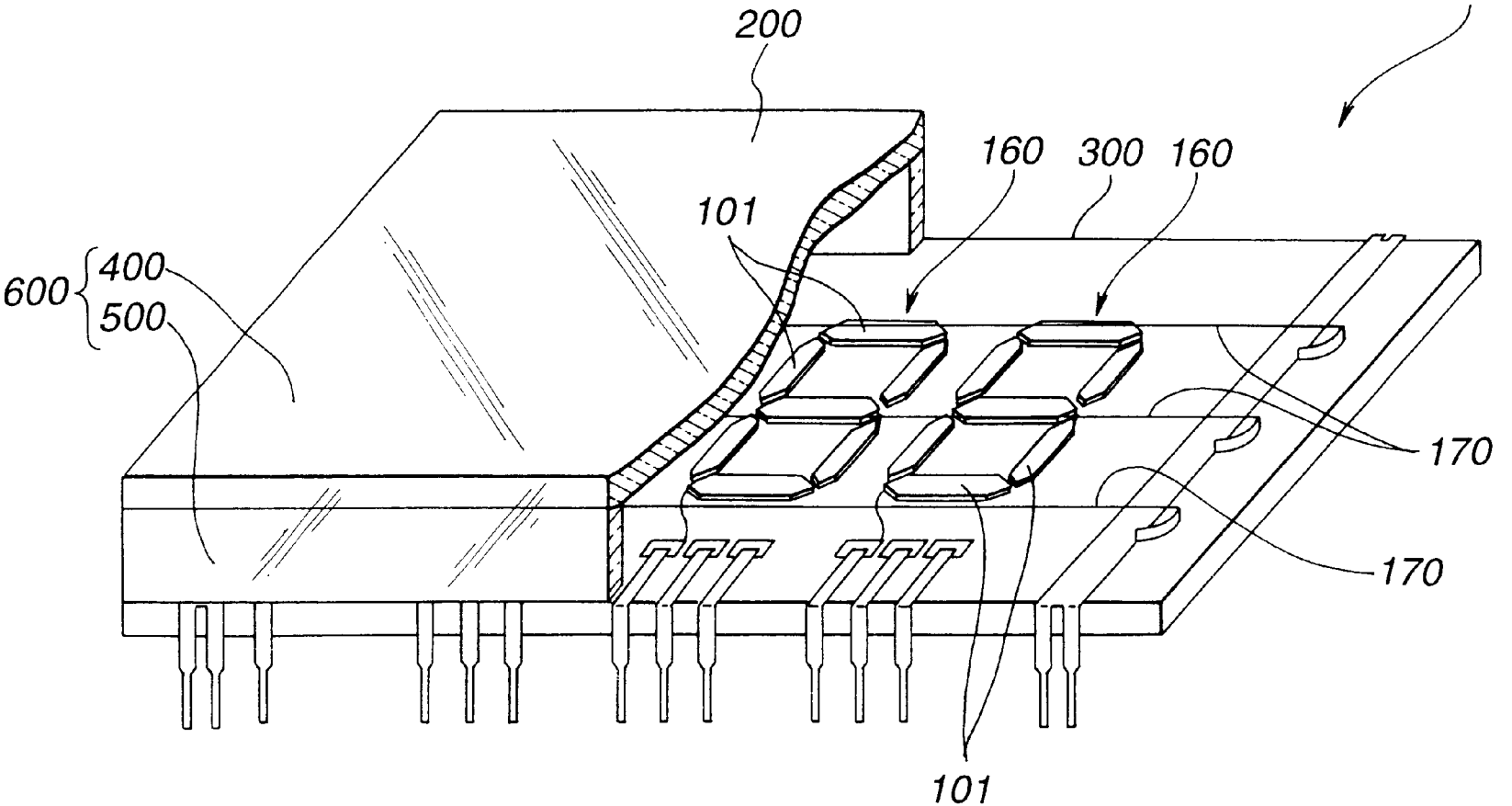
FIG.8 PRIOR ART
FIG. 8 is a partially cut-away perspective view generally showing a conventional stereogrid-equipped fluorescent display device.
Figure 9:
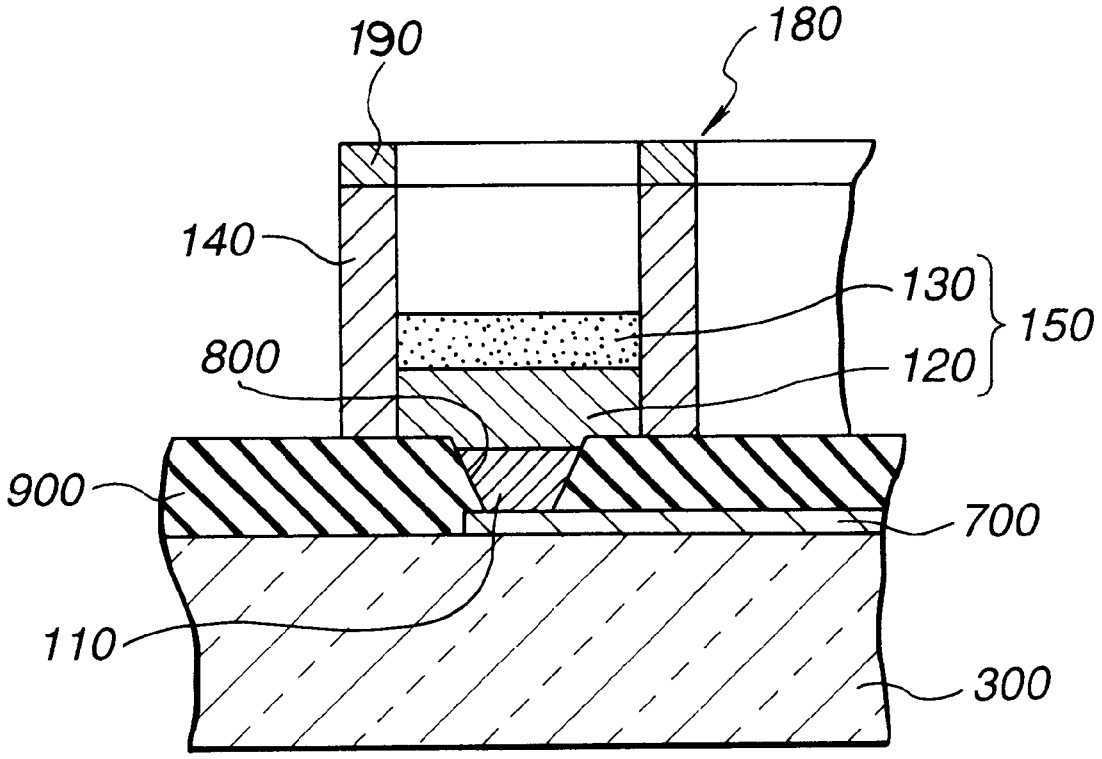
FIG.9 PRIOR ART
FIG. 9 is a fragmentary sectional view showing a conventional stereogrid-equipped fluorescent display device.
Figure 10:
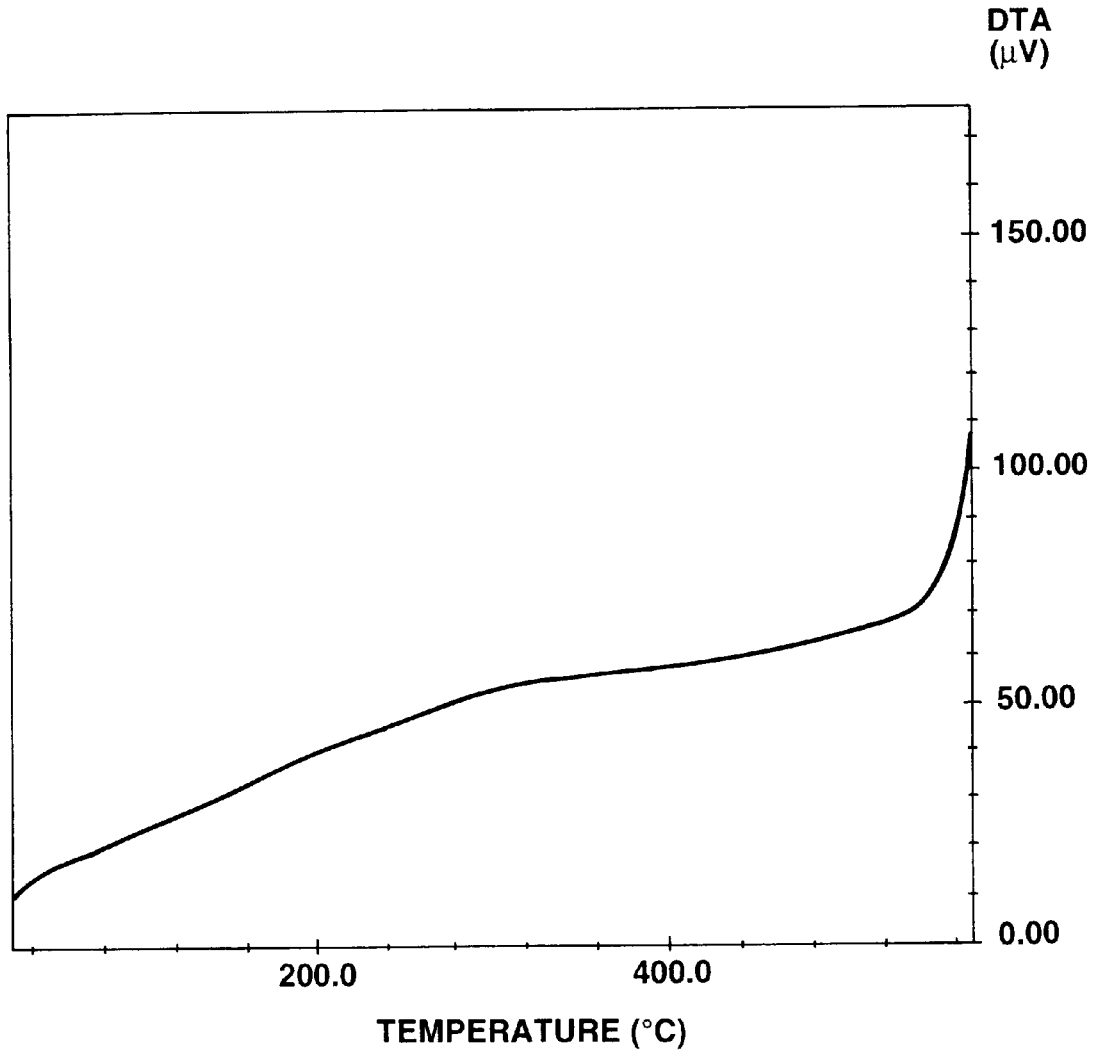
FIG. 10 is a graphical representation showing results of differential thermal analysis carried out on a fine Al powder calcined at 570° C.
Figure 11:
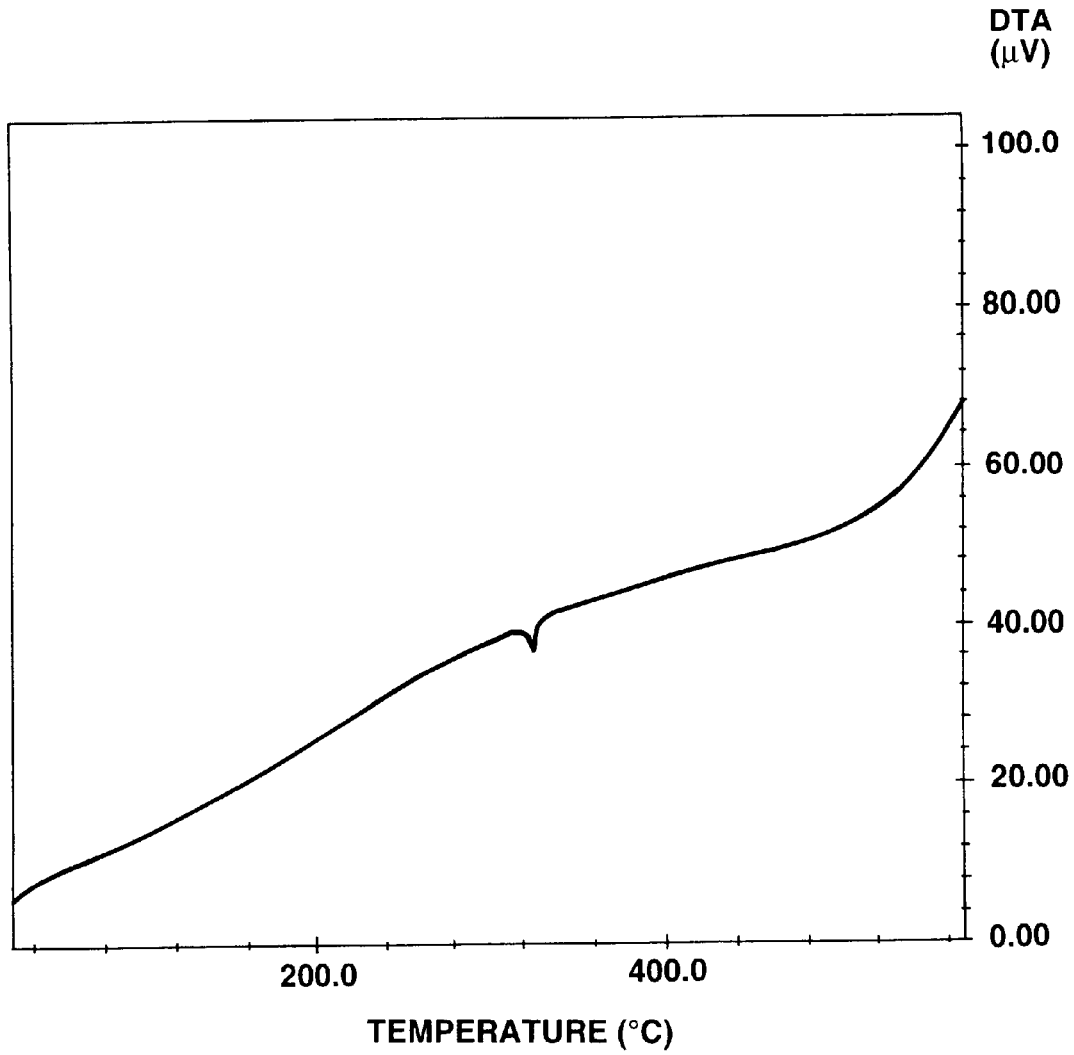
FIG. 11 is a graphical representation showing results obtained by subjecting a specimen to differential thermal analysis to a temperature of 570° C., wherein the specimen was prepared by mixing a fine Al powder with PbO glass frit to obtain a mixture and subjecting the mixture to calcination.
Figure 12:
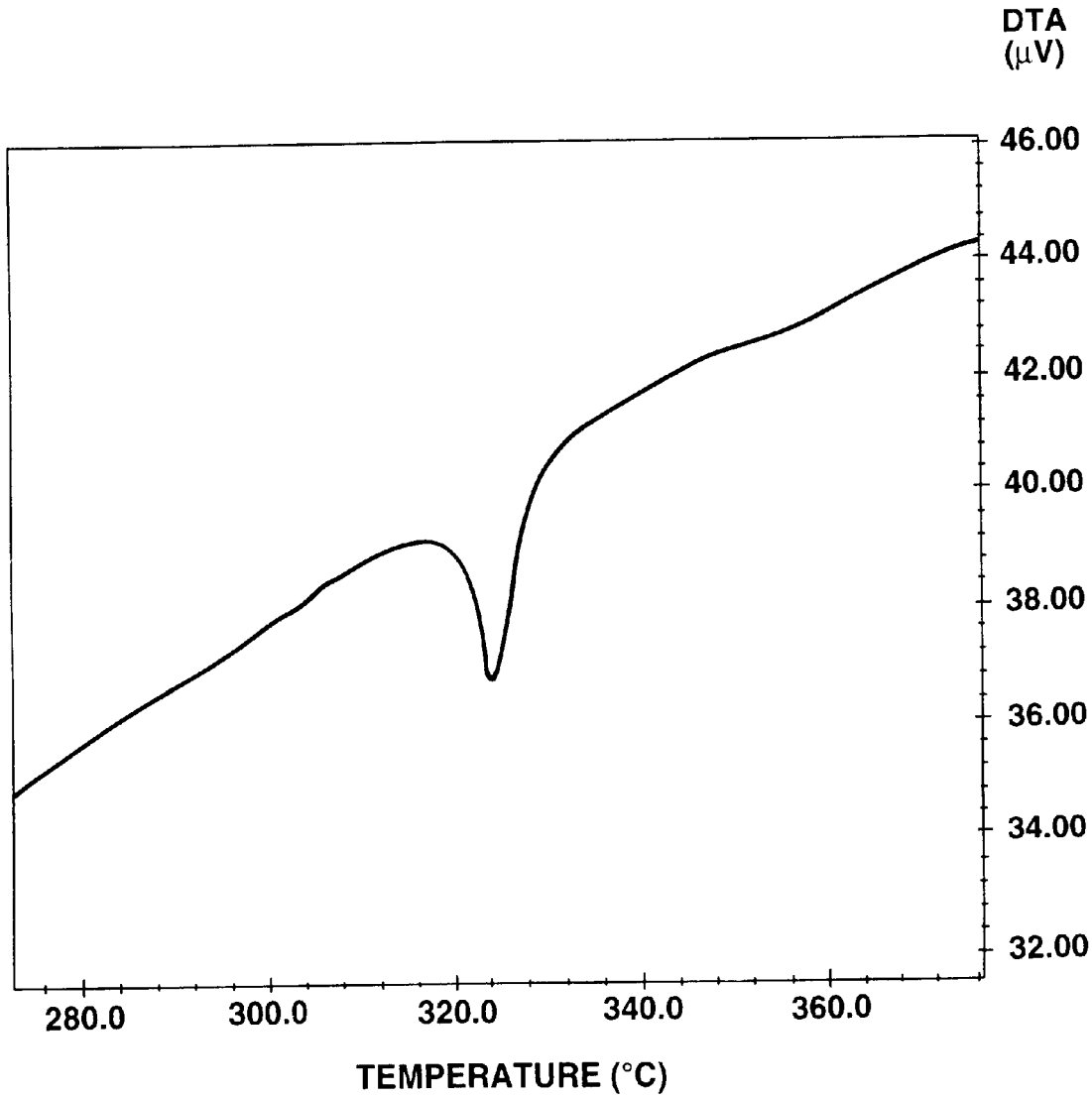
FIG. 12 is a graphical representation enlargedly showing a part of FIG. 11.

FIG. 5 shows an electrode structure in a fourth embodiment of a stereogrid-equipped fluorescent display device according to the present invention. The electrode structure shown in FIG. 5 is constructed in such a manner that intermediate layers 30 each are laminatedly arranged between each of partitions 26 and each of grid electrodes 27. Thus, an insulating layer 9 has the partition 26, intermediate layer 30 and grid electrode 27 laminatedly arranged thereon in order. The remaining part of the fourth embodiment may be constructed in substantially the same manner as the third embodiment described above.

The intermediate layers 30 each are formed of a paste mainly consisting of any one of organic metal and phosphate glass frit by screen printing. More particularly, the pastes mainly consisting of organic metal include a paste prepared by mixing an organic Ti compound with a vehicle, as well as a mixture of an organic Ti compound with an oxide and a vehicle. The pastes mainly consisting of phosphate glass frit include a mixture of a crystalline $P_2O_5$ glass frit with a vehicle, a mixture of $P_2O_5$ glass frit with an oxide and a vehicle, a mixture of $P_2O_5$ glass frit with an organic Ti compound and a vehicle, and a mixture of $P_2O_5$ glass frit with an organic Ti compound, an oxide and a vehicle. The oxide acts as a flow preventing filler. Alumina, $TiO_2$ or the like may be used as the oxide.

In the embodiments described above, the organic Ti compounds include organic Ti, organic Ti—Zn, organic Ti—P and the like. Also, the $P_2O_5$ glass frit may mainly consist of $P_2O_5$—SnO, $P_2O_5$—SnO—ZnO, $P_2O_5$—ZnO or the like.

Now, manufacturing of the stereogrid-equipped fluorescent display device of the third embodiment including the electrode structure shown in FIG. 4 will be described.

First, a conductive material such as Al or the like is subject to patterning on an anode substrate 3, to thereby form a wiring (anode wiring, grid wiring) 7. Then, the above-described insulating layer 9 formed with through-holes 11 are formed on the anode substrate 3 so as to cover the wiring 7 by printing. At this time, formation of the insulating layer 9 by printing is so carried out that the through-holes 11 each are positioned at a connection among each of segments 20 constituting a display pattern, each of the grid electrodes 27 formed in the subsequent step and a grid wiring conductor (not shown).

Then, the through-hole 11 of the insulating layer 9 positioned at each of the segments 8 is formed therein with a conductive material such as Al or the like by printing, to thereby be filled with a conductive layer 12. Concurrently, the conductive material 12 such as Al or the like is formed in the through-hole 11 positioned at a connection between each of the grid electrodes and the grid wiring conductor, resulting in the through-hole 11 being filled with the conductive layer 12.

Subsequently, the conductive layers 12 filled in the through-holes each are formed thereon with a conductive paste of graphite or the like in the shape of the segment 20 by printing, to thereby provide an anode conductor 23. Then, the anode conductors 23 each are provided thereon with a phosphor layer 24 in the form of the segment 20 by printing. Then, the insulating paste of glass frit is screen-printed in a predetermined width on each of the phosphor layers 24, to thereby form the above-described partition 26. Formation of the partition 26 by printing is carried out by repeating the printing and drying (80 to 200° C.) plural times, because a height (for example, 20 $\mu$m for each layer) of the partition obtained by one-time printing is insufficient for the partition 26 desired. This permits the partition 26 of a desired height to be formed by printing, resulting in an anode 25 partitioned for every segment 20 being provided.

Then, the partitions 26 each are formed on a top thereof with a nonleaded conductive paste constituted by Al metal containing at least one of phosphate glass frit and organic metal by screen printing, which is then calcined at a temperature of 550 to 600° C. The conductive paste for formation of the partition 26 is free of lead, so that formation of the grid electrode 27 on the top of the partition 26 is carried out without causing precipitation of Pb due to oxidation of Al.

Separately from the above operation, a frame on which filamentary cathodes 17 are stretchedly arranged is assembled. Then, a side plate 5 of a casing 6 is positioned at a bottom peripheral surface thereof on an outer periphery of the anode substrate 3 on which an adhesive constituted by a low-melting paste is coated. Then, the anode substrate 3 and casing 6 are vertically pressed against each other, to thereby be sealed to each other, resulting in a vacuum envelope 2 being assembled. Then, the vacuum envelope 2 is evacuated at a high vacuum and then sealed, thus, the stereogrid-equipped fluorescent display device is finished.

Manufacturing of the stereogrid-equipped fluorescent display device of the fourth embodiment including the electrode structure shown in FIG. 5 is carried out in a manner to form the partitions 26 on the insulating layer 9 by printing and then form the paste mainly consisting of the organic metal or phosphate glass frit on the top of the partition by screen printing, to thereby form the intermediate layer 30 described above. Then, the nonleaded conductive paste constituted by Al containing at least one of the organic metal and phosphate glass frit is screen-printed on the top of each of the partitions 26 and then subject to calcination at 550 to 600° C. The remaining procedure is carried out in substantially the same manner as in the above-described manufacturing of the stereogrid-equipped fluorescent display device of the third embodiment including the electrode structure shown in FIG. 4. Such construction permits the intermediate layer 30 to isolate the partition 26 and grid electrode 27 from each other, to thereby prevent the Al paste for the grid electrode 27 from entering the partition 26, resulting in eliminating electrical connection between an anode conductor 23 and the grid electrode 27.

In formation of the intermediate layer 30 by screen-printing of the paste mainly consisting of the phosphate glass frit on the top of the partition 14, a softening point of the intermediate layer 30 is set to be higher than a sintering temperature of the grid electrode and a sintering temperature of the intermediate layer 30 is set to be lower than a softening point of the partition 26. This permits the Al conductive paste for the grid 27 to be melted and solidified during calcination. Then, the paste for the intermediate layer 30 mainly consisting of the phosphate glass frit is melted and solidified and then the paste for the partition 26 mainly consisting of the glass frit is melted and solidified. This prevents the partition 36 from being porous due to melting thereof, before the intermediate layer 30 is crystallized.

When the insulating paste made by mixing the organic Ti compound with the vehicle is screen-printed on the top of each of the partitions 26, the intermediate layer 30 formed is caused to be reduced in thickness, so that the intermediate layer 30 is formed into a multi-layer structure by repeating printing and drying plural times. This prevents the intermediate layer 30 from being porous, resulting in a reduction reaction of Pb between the partition 26 and the grid electrode 27 being prevented by the intermediate layer 30.

Thus, the electrode structure in the fluorescent display device of the third embodiment permits the grid electrode 27 to be formed of the nonleaded conductive paste constituted by Al containing at least one of the organic metal and phosphate glass frit by printing, so that precipitation of Pb on the grid electrode 27 due to reduction of PbO by oxidation of Al during the calcination as encountered in the prior art may be effectively eliminated.

Also, the electrode structure in the fluorescent display device of the fourth embodiment permits screen printing of the insulating paste mainly consisting of the organic metal or phosphate glass frit to provide a laminate structure wherein the intermediate layer 30 is interposedly arranged between the partition 26 and the grid electrode 27. Thus, use of the insulating paste containing frit glass for the partition 26 effectively prevents reduction of PbO due to oxidation of Al at the interface between the partition 26 and the grid electrode 27 during calcination, so that the fluorescent display device may be increased in emission characteristics and durability.

Figure 13:
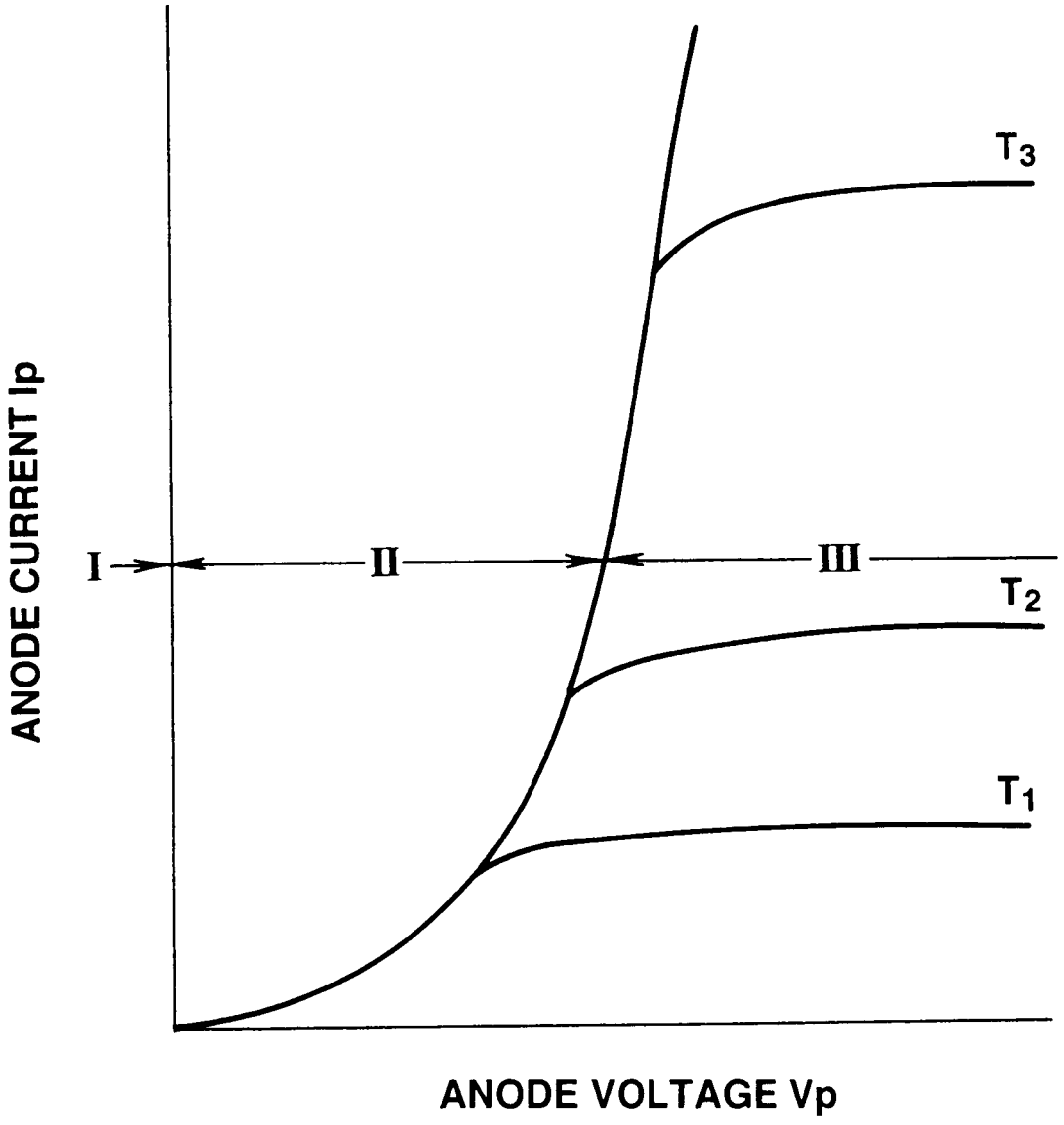
FIG. 13 is a diagrammatic view showing static characteristics of a typical diode.

FIG. 13 shows static characteristics of a typical diode. In FIG. 13, a region indicated at I is called an initial velocity current region, wherein of electrons emitted from a cathode, electrons having energy sufficient to overcome a negative anode voltage are fed to an anode.

As the anode voltage is increased from a negative side to a positive side, a number of electrons are further emitted from the cathode toward the anode while being accelerated, so that the electrons emitted fill a space between the anode and the cathode. This results in equilibrium being kept in a state that the cathode is shielded with the electrons. This occurs in a region II, which is called a space charge restriction region. When the anode voltage is further increased, a temperature restriction region III is defined wherein an anode current is restricted by an electron emission capability of the cathode. A whole current Is fed from the cathode is expressed by the following Richardson-Dushmann equation:

$$Is=SAT^{n}\exp(-e\phi/KT)$$

Thus, propriety of the cathode is evaluated by measuring Is while keeping a temperature T in the temperature restriction region constant. The Is is called emission.

In view of the measurement principle described above, the inventors evaluated emission of each of the conventional Al conductive paste containing lead glass frit and the nonleaded Al conductive paste of the illustrated embodiment by mounting each of the pastes in a fluorescent display device of a diode structure.

As a result, it was found that supposing that emission by the conventional electrode structure is 100, the electrode structure incorporated in the third embodiment exhibits emission of 200 to 300 depending on the conductive paste selected for the grid electrode 27 and the electrode structure incorporated in the fourth embodiment exhibits emission as high as 1500 or more depending on the conductive paste selected for the grid electrode 27 and the insulating paste selected for the intermediate layer 30.

Also, the conventional electrode structure produced a dark line in 1000 hours. On the contrary, the electrode structure of the third embodiment did not produce any dark line even after lapse of 10000 hours, leading to an increase in durability.

As can be seen from the foregoing, in the fluorescent display device of the present invention, the grid electrode is formed of the nonleaded conductive paste constituted by Al containing at least one of the organic metal and phosphate glass frit by screen printing. This positively prevents precipitation of Pb on the grid electrode due to reduction of PbO by oxidation of Al during calcination of the conductive paste, to thereby significantly increase emission of the fluorescent display device.

Also, the fluorescent display device of the present invention may be constructed so that the intermediate layer which is formed of the paste mainly consisting of any one of the organic metal and phosphate glass frit is laminatedly arranged between the partition and the grid electrode. Such construction, when the partition is made of the insulating paste containing the PbO glass frit, permits the intermediate layer thus arranged to interrupt electrical connection between the grid electrode and the partition. This prevents reduction of PbO due to oxidation of Al at an interface between the partition and the grid electrode during calcination of the conductive paste, to thereby further enhance emission characteristics and durability of the fluorescent display device.

Formation of the intermediate layer by screen printing of the paste mainly consisting of the phosphate glass frit may be carried out by setting a softening point of the intermediate layer above a sintering temperature of the grid electrode and setting a sintering temperature of the intermediate layer below a softening point of the partition during the calcination. This permits the partition to be melted before crystallization of the intermediate layer, to thereby prevent the intermediate layer from being porous.

Further, in the present invention, the partition is formed by screen-printing of the nonleaded insulating paste containing the phosphate glass frit and the grid electrode is formed by screen-printing of the nonleaded conductive paste constituted by the Al metal containing at least one of the organic metal and phosphate glass frit. This prevents precipitation of Pb on the grid electrode due to reduction of PbO by oxidation of Al during the calcination as encountered with the prior art, resulting in emission characteristics of the fluorescent display device being increased. Also, this prevents reduction of PbO due to oxidation of Al at an interface between the partition and the grid electrode during the calcination, so that emission characteristics and durability of the fluorescent display device may be further enhanced.

In addition, in the present invention, the conductive paste mainly consisting of Al which is substantially the same as the Al wiring layer is filled in each of the through-holes of the insulating layer, to thereby positively ensure electrical connection between the wiring layer and the anode conductor while exhibiting satisfactory conformability to the wiring layer.

Further, Al which is a main component of the conductive paste is in the form of a fine powder of 1 to 10 $\mu$m in average particle diameter, so that an oxide film on the Al powder and that on the Al wiring layer may be readily broken by the oxidation reaction, to thereby ensure satisfactory electrical connection between the wiring layer and the anode conductor. The reaction is kept from excessively taking place irrespective of repeated calcination at 550 to 600° C.

Also, the conductive paste mainly consisting of Al which is used in the present invention is reduced in resistance and exhibits stable resistance as compared with a conductive paste mainly consisting of Ag, so that the fluorescent display device of the present invention may attain cost-savings and stable operation.

Furthermore, in the present invention, the conductive layer is made of a conductive material mainly consisting of Al having a resistance substantially reduced to a level as low as 20 mΩ/□, as compared with graphite used in the prior art. This minimizes generation of heat from the conductive layer during luminescence thereof, to thereby significantly restrain a deterioration in luminance due to an increase in temperature in the vacuum envelope.

Moreover, the conductive layer constituted by the Al electrode formed by melting and solidification of the glass powder is reduced in specific surface area, to thereby reduced in gas adsorption as compared with a graphite electrode in the prior art, leading to an increase in electron emission capability of the cathode.

Also, the present invention may be so constructed that the background on the periphery of the phosphor layer on the anode substrate which is viewed through the substrate opposite to the anode substrate is rendered substantially white. Such construction prevents the segments of the display pattern of the phosphors kept turned off from being seen through, even when the fluorescent display device of the present invention is mounted on an instrument display panel of a vehicle or is set outdoors in the form of a display unit such as a measuring instrument for a gasoline station. Also, the conductive layer is formed to be inherently whitish, resulting in being reduced in light absorption and reflecting a part of light, leading to an increase in luminance, as compared with the conventional conductive layer made of graphite.

Further, the fluorescent display device of the present invention is irrelevant to the construction of the prior art that the phosphor is black-rimmed at a periphery thereof, Such construction of the prior art causes the black-rimmed periphery to be seen through by external light. Thus, the present invention eliminates such a disadvantage as encountered with the prior art.

In addition, in the present invention, the conductive layer is constituted by the Al electrode reduced in resistance, so that uniform luminescence of a phosphor increased in resistance such as $Ln_2O_2S$:Re phosphors, a ZnS:Zn or ZnS:Cu,Al sulfide phosphor, $ZnGa_2O_4$ phosphors or the like under a voltage as low as about 20 to 150 V may be ensured.

The phosphor for the phosphor layer formed on the conductive layer may be selected from the above-described phosphors increased in resistance, as well as phosphors reduced in resistance such as ZnO:Zn conventionally used in the art. Such low-resistance phosphors contribute to an increase in luminance as compared with the high-resistance phosphors.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A fluorescent display device, comprising stereogrids each including a partition made of an insulating material and arranged so as to surround a phosphor layer deposited on each of anode conductors and a grid section formed of a conductive layer by printing and arranged on a top of said partition;

an intermediate layer arranged between said partition of each of said stereogrids and said conductive layer thereof;

said grid section being formed of aluminum paste containing an aluminum powder, phosphate frit glass or bismuth oxide frit glass, and an organic metal, wherein said organic metal is selected from the group consisting of organic aluminum compounds, organic silver compounds, organic chromium compounds, organic silicon compounds, organic cobalt compounds, organic tin compounds, organic tungsten compounds, organic copper compounds, organic lead compounds, organic nickel compounds, and organic titanium compounds;

said intermediate layer mainly consisting of a metal oxide of calcined organic metal and calcined phosphate or bismuth oxide frit glass.

2. A fluorescent display device, comprising stereogrids each including a partition made of an insulating material and arranged so as to surround a phosphor layer deposited on each of anode conductors and a grid section formed of a conductive layer by printing and arranged on a top of said partition;

an intermediate layer arranged between said partition of each of said stereogrids and said conductive layer thereof;

said grid section being formed of aluminum paste containing an aluminum powder, phosphate frit glass or bismuth oxide frit glass, and an organic metal, wherein said organic metal is selected from the group consisting of organic aluminum compounds, organic silver compounds, organic chromium compounds, organic silicon compounds, organic cobalt compounds, organic tin compounds, organic tungsten compounds, organic copper compounds, organic lead compounds, organic nickel compounds, and organic titanium compounds;

said intermediate layer mainly consisting of phosphate frit glass;

said intermediate layer during calcination of said stereogrid having a softening point set to be higher than a sintering temperature of said grid section and a sintering temperature set to be lower than a softening point of said partition.

* * * * *

UNITED STATES PATENT AND TRADEMARK OFFICE

CERTIFICATE OF CORRECTION

PATENT NO. : 6,525,468 B1
DATED : February 25, 2003
INVENTOR(S) : Wada et al.

It is certified that error appears in the above-identified patent and that said Letters Patent is hereby corrected as shown below:

Title page,
Item [30], Foreign Application Priority Data, should read:

-- [30] Foreign Application Priority Data

Jun. 18, 1998 (JP) ..... 10-171597
Jun. 18, 1998 (JP) ..... 10-171598
Jun. 18, 1998 (JP) ..... 10-171600
Jun. 18, 1998 (JP) ..... 10-171601 --

Signed and Sealed this

Eighth Day of July, 2003

JAMES E. ROGAN
*Director of the United States Patent and Trademark Office*